US007963053B1

(12) United States Patent
Courville

(10) Patent No.: US 7,963,053 B1
(45) Date of Patent: Jun. 21, 2011

(54) BOOM MOUNTED EXCAVATOR FOR CLEANING UNDER BRIDGES INSIDE OF PIPE AND DRAINAGE DITCHES

(75) Inventor: Mickey Courville, Breaux Bridge, LA (US)

(73) Assignee: Courville & Dugas, Inc., Breaux Bridge, LA (US)

( * ) Notice: Subject to any disclaimer, the term of this patent is extended or adjusted under 35 U.S.C. 154(b) by 0 days.

(21) Appl. No.: 12/478,565

(22) Filed: Jun. 4, 2009

Related U.S. Application Data

(60) Provisional application No. 61/058,799, filed on Jun. 4, 2008.

(51) Int. Cl.
*E02F 3/96* (2006.01)

(52) U.S. Cl. ..... 37/405

(58) Field of Classification Search ..... 37/403–409, 37/466, 468, 446, 444, 450; 172/772, 773, 172/701.3; 414/685, 74, 724, 912
See application file for complete search history.

(56) References Cited

U.S. PATENT DOCUMENTS 3,214,041 A 10/1965 Walberg
3,706,388 A 12/1972 Westendorf
3,749,262 A 7/1973 Stark
4,125,952 A 11/1978 Jennings
4,242,035 A 12/1980 Hornstein
4,417,628 A * 11/1983 Gessner ..... 173/29
4,547,984 A 10/1985 Adams
5,953,839 A * 9/1999 Meeks ..... 37/404
6,000,152 A 12/1999 Tate
6,074,160 A * 6/2000 Brumbaugh et al. ..... 414/704
6,098,321 A * 8/2000 Logan ..... 37/409
6,405,460 B1 * 6/2002 Whitmire et al. ..... 37/405
6,718,662 B1 4/2004 Schaff

* cited by examiner

*Primary Examiner* — Robert E Pezzuto
(74) *Attorney, Agent, or Firm* — Garvey, Smith, Nehrbass & North, L.L.C.; Seth M. Nehrbass; Charles C. Garvey, Jr.

(57) ABSTRACT

An excavator provides a frame that includes an undercarriage having a ground engaging propeller (e.g. endless tracks) that enables the undercarriage to move the frame. The frame includes an upper portion that supports an elongated articulating boom having at least two boom sections that are pivotally connected. The frame provides an enclosure having a motor drive and a hydraulic system that powers the boom, and a cab rotatable upon the undercarriage about a generally vertical axis. The boom has a distal end with a bucket that has one or more bucket teeth. A scraper is connected to the boom distal end and provides another end that is extendable to a position generally below the cab and to the vertical axis. A connection joins the boom distal end to the scraper. The connection includes a connection of the bucket to the proximal end of the scraper and to the upper surface of the scraper wherein the bucket tooth connects to the scraper.

20 Claims, 7 Drawing Sheets

BOOM MOUNTED EXCAVATOR FOR CLEANING UNDER BRIDGES INSIDE OF PIPE AND DRAINAGE DITCHES

CROSS-REFERENCE TO RELATED APPLICATIONS

Priority of U.S. Provisional Patent Application Ser. No. 61/058,799, filed 4 Jun. 2008, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to excavating devices and more particularly to an improved excavator that employs an elongated scraper connectable to an articulating boom that is powered by a hydraulic system of a rotating upper or cab that is mounted on a propelled lower (for example, tracked vehicle). In one embodiment, a quick release connection is formed between a bucket mounted on the distal end of the boom and a specially configured attachment that is on the proximal end portion of the scraper. In another embodiment, spaced apart openings at the distal end of the boom form connections with spaced apart openings on the proximal end of the scraper.

2. General Background of the Invention

Implements are typically employed that can be attached to an end portion of a commercially available hydraulic excavator, sometimes referred to as a "back hoe". Hydraulic excavators or back hoes are known in the art, sold by Caterpillar® and others (www.cat.com). Such hydraulic excavators employ an undercarriage having a ground engaging propelling means such as endless tracks. The undercarriage supports an upper with an elongated articulating boom having at least two boom sections that are pivotally connected. Such back hoes also employ as part of the "upper" a motor drive that powers a hydraulic system that is used to move the boom. The cab is typically rotatable upon the undercarriage about a vertical axis. The distal end of the boom carries an implement such as a bucket.

Patents have issued that are directed to such excavators and implements that attach to the distal end of the boom. Examples are found in the following table.

The following U.S. Patents are incorporated herein by reference:

TABLE

| U.S. Pat. No. | TITLE | ISSUE DATE |
|---|---|---|
| 3,214,041 | Scoop for Front End Loaders | Oct. 26, 1965 |
| 3,706,388 | Fork Attachment for a Loader Bucket | Dec. 19, 1972 |
| 3,749,262 | Power Shovel with Scraper Blade Releasably Attached to the Shovel Bucket | Jul. 31, 1973 |
| 4,125,952 | Bucket Attachment | Nov. 21, 1978 |
| 4,242,035 | Apparatus for Converting a Loader Bucket to a Pallet Loader | Dec. 30, 1980 |
| 4,547,984 | Brush Uprooting Attachment | Oct. 22, 1985 |

TABLE-continued

| U.S. Pat. No. | TITLE | ISSUE DATE |
|---|---|---|
| 6,000,152 | Culvert Cleaning Apparatus | Dec. 14, 1999 |
| 6,718,662 | Do-All Rake-Tooth Bucket Extension Attachment | Apr. 13, 2004 |

BRIEF SUMMARY OF THE INVENTION

The present invention provides an improved hydraulic excavator that employs a frame, an undercarriage having ground engaging tracks or wheels that enable the undercarriage to move the frame. The frame includes an upper that supports an elongated articulating boom having at least two boom sections that are pivotally connected.

The frame includes a cab that rotates about a generally vertical axis upon the undercarriage. The cab or upper can contain an engine and a hydraulic system that powers the boom.

The boom has a distal end portion that includes a boom section and an extensible ram. The boom distal end can be connected to a digging implement such as a bucket having one or more teeth.

The present invention employs a scraper having one end connected to the boom distal end and another end that is extendable to a position generally below the cab and to the vertical axis. A connection joins the boom distal end to the proximal end of the scraper.

In one embodiment, a connection is perfected between the bucket and the proximal end of the scraper. The connection also connects to the upper surface of the scraper wherein the bucket teeth connect to the scraper.

In another embodiment, an end portion of the boom is pivotally connected at spaced apart locations to a connector on the proximal end of the scraper.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
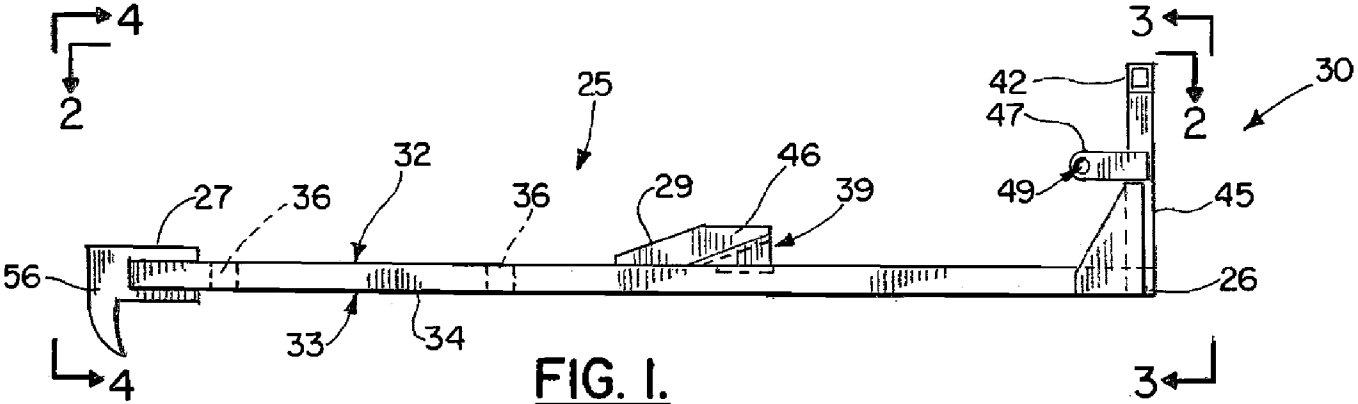
FIG. 1 is a side view of the preferred embodiment of the apparatus of the present invention.
Figure 2:
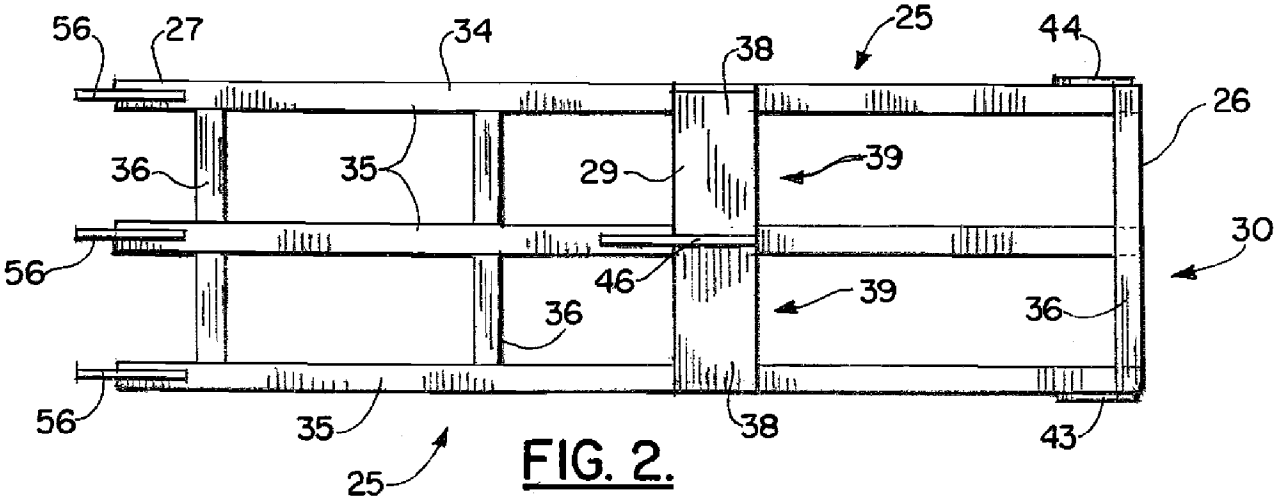
FIG. 2 is a top view of the preferred embodiment of the apparatus of the present invention, taken along lines 2-2 of FIG. 1.
Figure 3:
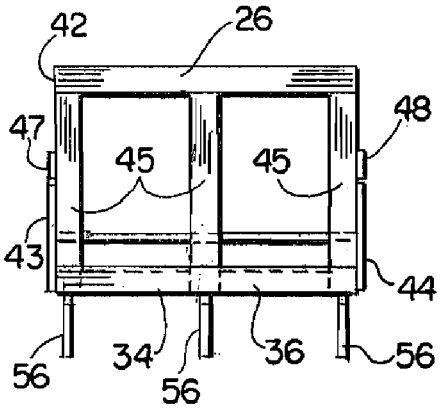
FIG. 3 is an end view of the preferred embodiment of the apparatus of the present invention, taken along lines 3-3 of FIG. 1.
Figure 4:
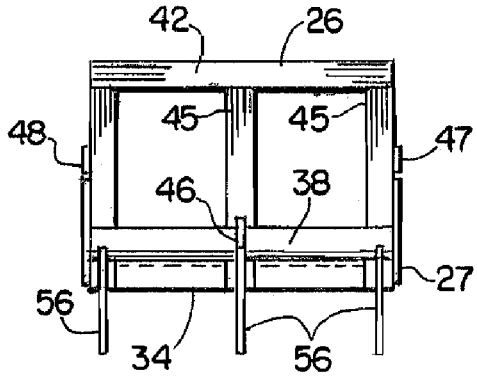
FIG. 4 is an end view of the preferred embodiment of the apparatus of the present invention, taken along lines 4-4 of FIG. 1.
Figure 5:
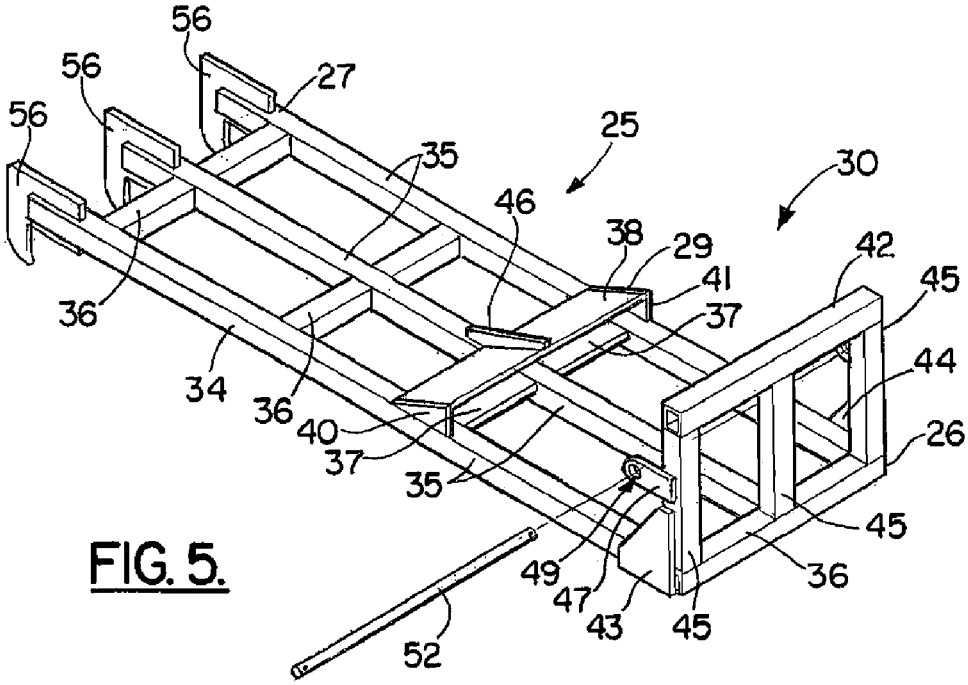
FIG. 5 is a perspective view of the preferred embodiment of the apparatus of the present invention.
Figure 6:
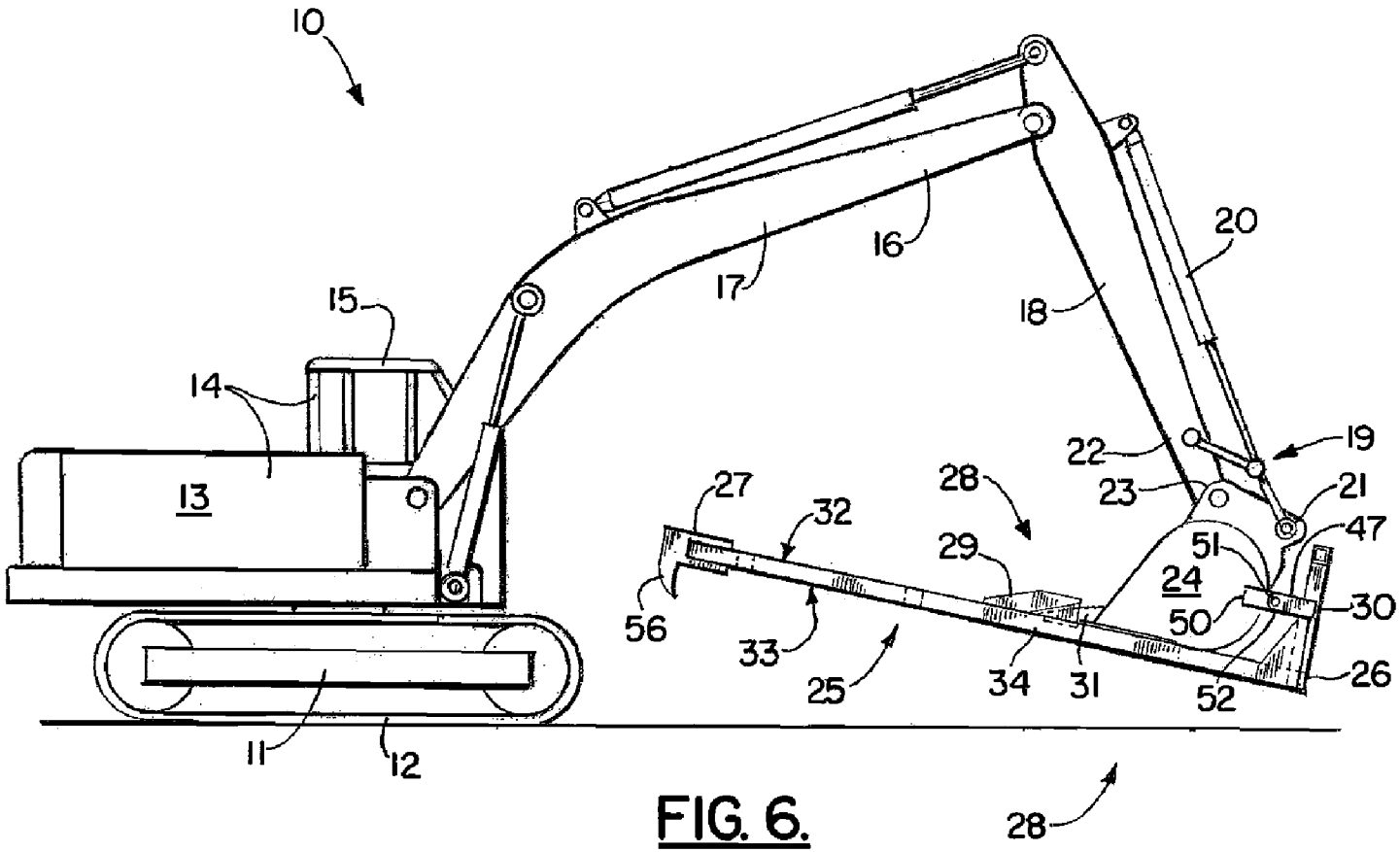
FIG. 6 is a side view of the preferred embodiment of the apparatus of the present invention.

FIGS. 1-6 show generally the preferred embodiment of the apparatus of the present invention, designated generally by the numeral 10. Excavator 10 employs an undercarriage which can for example be an endless tracked undercarriage powered by an engine. The undercarriage 11 with endless tracks 12 and upper 14 are part of an overall frame that is commercially available. The upper 14 provides a cab 15 for an operator. Upper 14 includes an enclosure 13 having an engine and a hydraulic system.

The upper 14 supports a boom 16. The boom 16 can have boom sections 17, 18 and a boom distal end 19. The boom section 18 can employ extensible ram 20 having opening 21. The boom section 18 can provide a boom section end 22 having boom opening 23. Boom 16 distal end portion 19 is connectable to bucket 24. Bucket 24 has one or more bucket teeth 31.

The upper 15 rotates upon the undercarriage 11 about a generally vertical axis. The boom distal end 19 attaches to a scraper 25. Scraper 25 has a proximal end 26 and a distal end 27. Distal end 27 provides one or more digging or scraping implements 56 such as a tooth or teeth or blade. Connector 28 enables a connection to be formed between scraper proximal end 26 and boom distal end 19. In one embodiment, the connector 28 provides a pair of spaced apart fixtures 29, 30. These fixtures 29, 30 enable connections to be formed between bucket 24 and scraper 25 proximal end 26.

In FIGS. 1-6, scraper 25 is constructed of a frame 34 that can be of welded steel or other welded material construction. Frame 34 has longitudinal beams 35 and transverse beams 36. Scraper 25 has upper surface 32 and lower surface 33.

Fixture 29 is a fixture that is receptive of teeth (or tooth or blade) 31 of bucket 24. The fixture 29 has a lower plate or plates 37, upper plate or plates 38, side plates 40, 41 and socket 39 that is receptive of the teeth (or tooth or blade) 31 of bucket 24. Gusset plate 46 reinforces the connection of upper plate or plates 38 to a longitudinal beam 35.

Fixture 30 is positioned at proximal end 26 of scraper 25 and extending upwardly from upper surface 33. Fixture 30 provides vertically extending beams 45 that extend upwardly from a transverse beam 36 that is next to proximal end 26 of scraper 25. The upper end portions of beams 45 are connected with transverse beam 42. Side plates 43, 44 are attached (e.g. welded) to the sides of scraper 25 at a longitudinal beam 35 and a vertically extending beam 45. Plates 43, 44 can be generally triangularly shaped.

Padeyes 47, 48 can be attached (e.g. welding) to opposing sides of fixture 30. Each padeye 47, 48 has an opening 49. Bucket 24 is fitted with padeyes 50, each having an opening 51. Rod 52 connects bucket 24 to fixture 30 by passing through the openings 49 of padeyes 47, 48 and the openings 51 of padeyes 50 (see FIGS. 5, 6, 7). The ends of rod 52 can be provided with openings that are receptive of locking pins or cotter pins to prevent removal of rod 52 after interlocked with padeyes 47, 48, 50.

Figure 7:
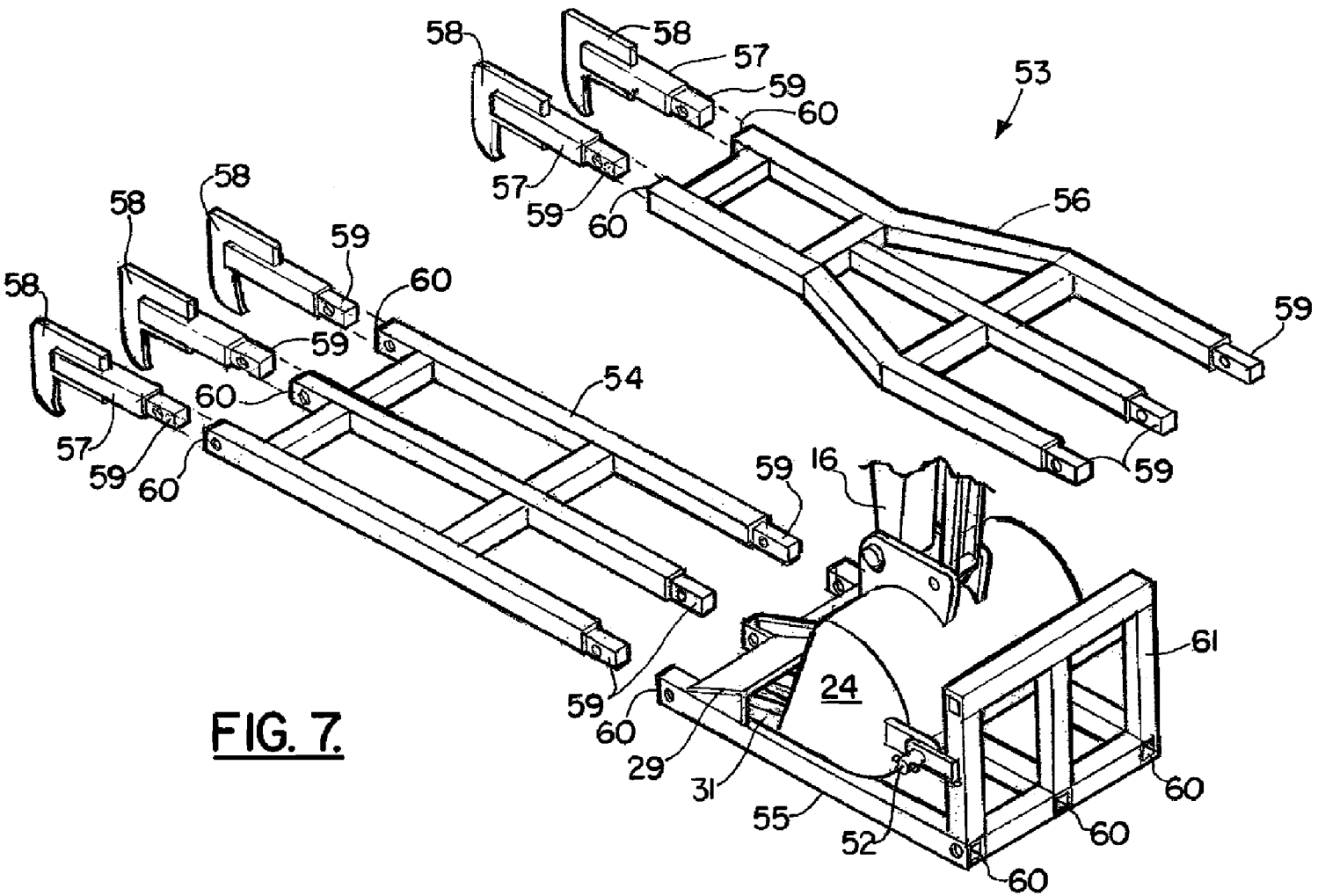
FIG. 7 is a perspective view of an alternate embodiment of the apparatus of the present invention.
Figure 11:
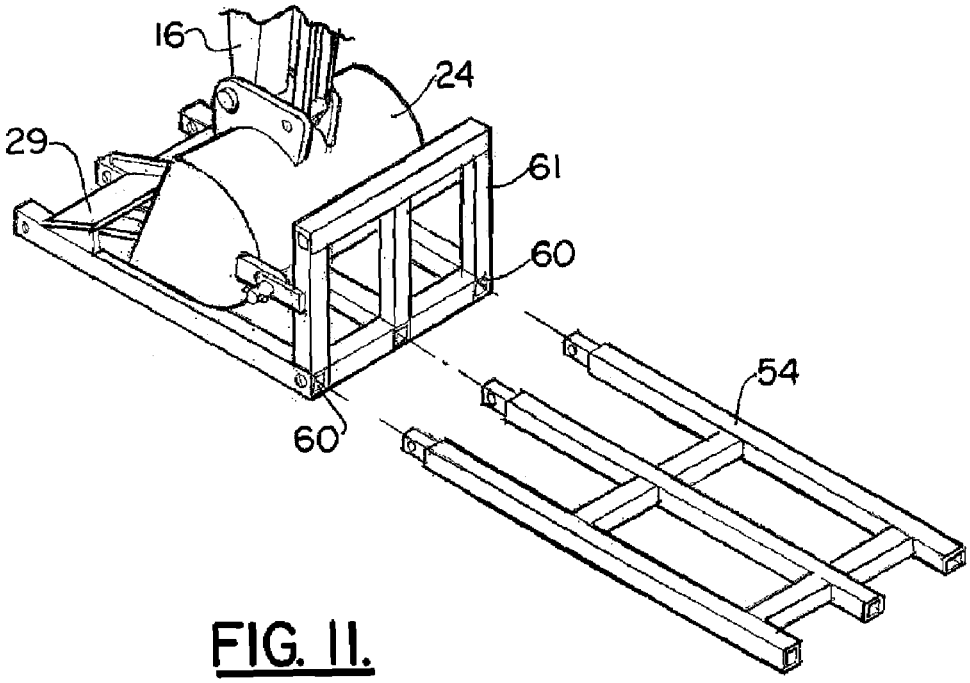
FIG. 11 is a partial perspective view of the alternate embodiment of the apparatus of the present invention.
Figure 12:
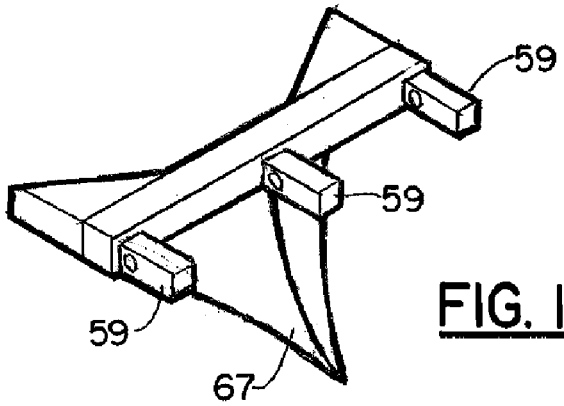
FIG. 12 is a fragmentary view of the alternate embodiment of the apparatus of the present invention showing a selectable removable end portion.

FIGS. 7 and 11 show an alternate embodiment of the apparatus of the present invention designated generally by the numeral 53. Scraper 53 provides multiple connectable frame sections 54, 55, 56. In FIG. 7, the frame sections can include a proximal frame section 55 and a central frame section 54 or 56. For the central frame sections 54, 56, either one will accept multiple implements 58 such as the teeth or blades 58 that are a part of the implement. The implements 57 attach to the central section 54 or 56 in a position that can be generally opposite the proximal frame section 55.

In order to connect the frame sections together and to connect the implements 57 to the frame sections 54, 55, or 56, interlocking or connectable projections 59 and sockets 60 are provided. The implement 57 in FIG. 7 can be connected to central frame section 56 using a projection 59 on implement 57 and a correspondingly sized and shaped socket 60 on the frame section 54. Openings through the projections 59 align with openings through the frame sections 54, 55, 56 through which a pin or fastener is inserted.

A common hitch type locking pin can be used to connect the implement 57 to the central frame section 54. Such locking pins are commonly employed for attaching a trailer hitch to a receiver on an automobile or truck. Other fasteners can be used to attach implements 57 to central frame sections 54 or 56 such as bolted connections, pins, rods or the like. As with the preferred embodiment, fixtures can be provided for enabling an attachment to be formed between bucket 24 and proximal frame section 55. Fixtures can include a fixture 29 that is basically the same as the fixture 29 in the preferred embodiment (FIGS. 1-6 and 8-10). Fixture 61 is similar to the fixture 30 of the preferred embodiment, but provides sockets 60 that enable a frame section 54 or 56 to be attached to the frame section 55 proximally as shown in FIG. 11.

Figure 8:
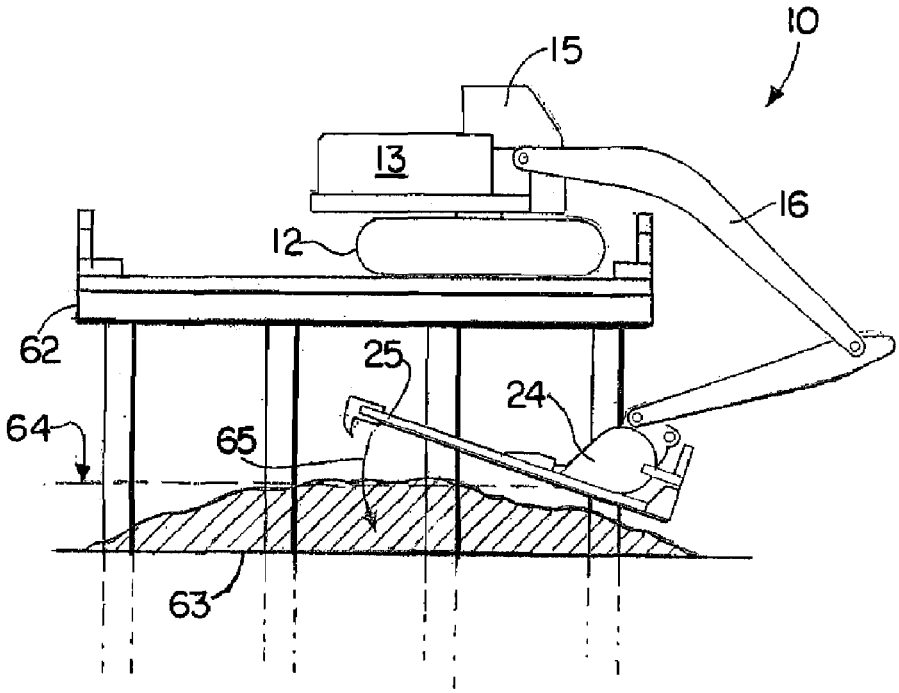
FIG. 8 is a side view of the preferred embodiment of the apparatus of the present invention during use.
Figure 9:
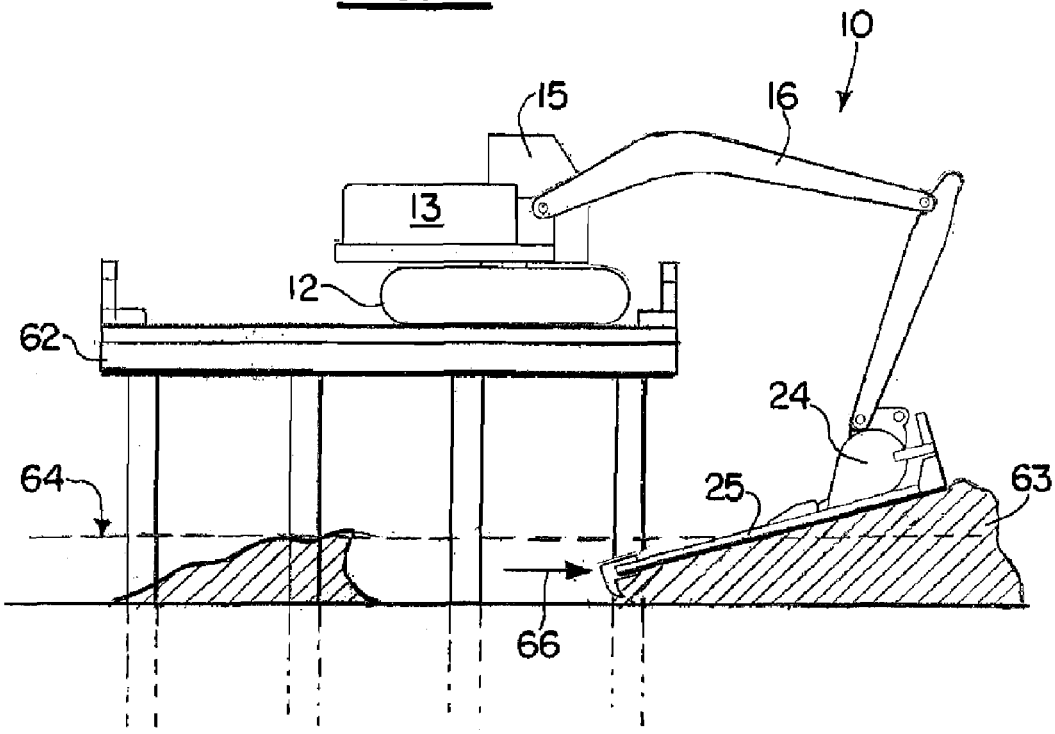
FIG. 9 is a side view of the preferred embodiment of the apparatus of the present invention during use.
Figure 10:
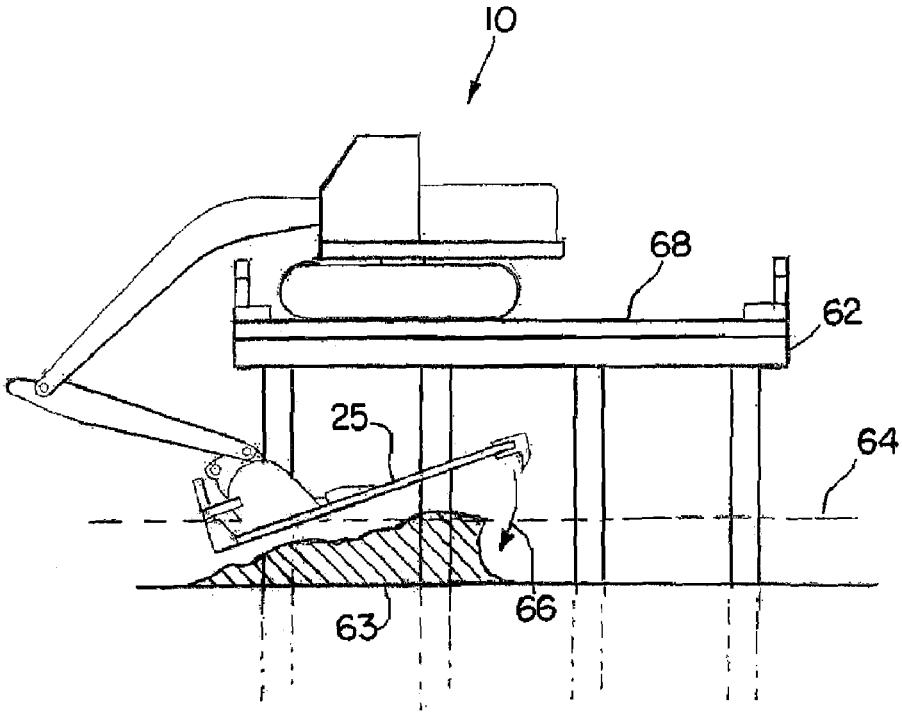
FIG. 10 is a side view of the preferred embodiment of the apparatus of the present invention during use.

FIGS. 8-10 illustrate use of the apparatus 10 of the present invention. FIGS. 8-10 show a bridge 62 wherein apparatus 10 occupies the position on the deck 68 of the bridge 62. Debris or sediment is indicated by the numeral 63. Such debris or sediment accumulate under the bridge 62 as shown in FIGS. 8-10. A water line at 64 may be present under bridge 62. Boom 16 moves scraper 25 or 53. Arrow 65 in FIG. 8 illustrates a downward movement of the distal end portion 27 of scraper 25 (or 53). In FIG. 9, arrow 66 indicates a lateral movement of the scraper 25 (or 53), pulling the debris 63 from under the bridge. In FIG. 10, the remaining part of the debris 63 is shown being removed by the scraper 25 (or 53) as illustrated by arrow 66.

Figure 13:
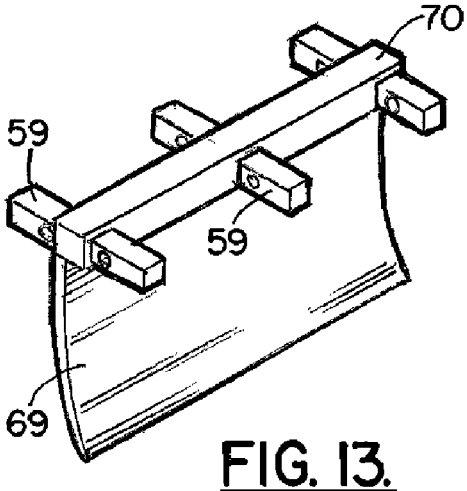
FIG. 13 is a fragmentary view of the alternate embodiment of the apparatus of the present invention showing a selectable removable end portion.
Figure 14:
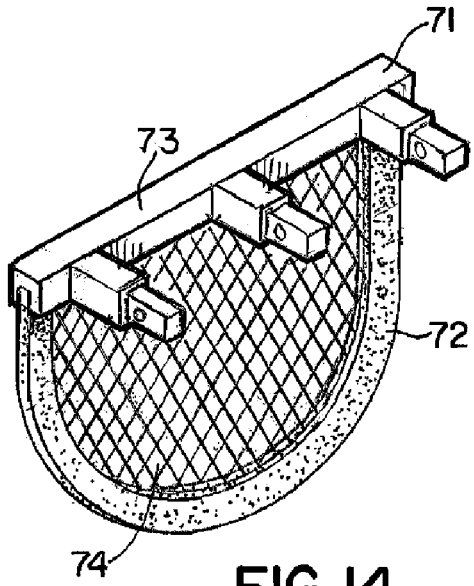
FIG. 14 is a fragmentary view of the alternate embodiment of the apparatus of the present invention showing a selectable removable end portion.

FIGS. 12-15 show other implements that could be used with the apparatus 10 of the present invention. The implement 67 for example is a plow having projections 59 that enable an attachment to any of the sockets 60 of the sections 54, 55, 56. The implement in FIG. 13 is a blade 69 having projections 59 that extend from both sides of beam 70 at the upper end portion of blade 69. In FIG. 14, the implement 71 is another blade, having a general U-shaped perimeter beam 72 which extends downwardly from an upper beam 73. The implement 71 is provided with a mesh or screen at 74.

Figure 15:
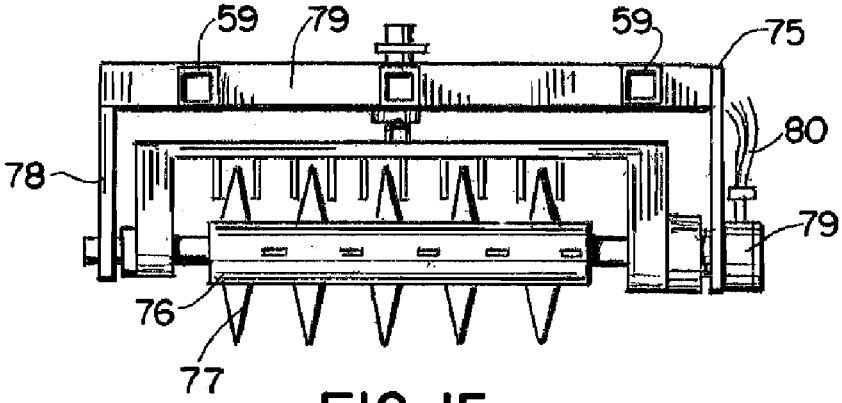
FIG. 15 is a fragmentary view of the alternate embodiment of the apparatus of the present invention showing a selectable removable end portion.

In FIG. 15, the implement 75 is a rotary powered implement that can be hydraulically powered using power from the backhoe. The implement 75 thus provides a rotating drum 76 having projection 77 thereon, the rotating drum 76 being supported by a frame 78. The frame 78 would provide an upper beam 79 having projections 59 for enabling a connection to be made with any of the frame sections 54, 55, 56. This implement 75 can be used as a tiller. It includes a hydraulic motor 79 with a hydraulic line 80.

The dimensions for central frame section 54 and central frame section 56 can be between 20" and 48" wide, preferably around 45" wide. The smaller the machine, the shorter it will be. The dimensions for the central frame section 54 and central frame section 56 can be 4' long to about 6' long. It is possible to use two of the same central frame sections 54 together. It is also possible to use one of central frame section 54 with one of central frame section 56 together.

A cable (not shown) can be used as a safety device to attach the various implements shown herein to a backhoe in the event of failure of pins holding the implements to the backhoe.

The following is a list of parts and materials suitable for use in the present invention.

PARTS LIST

| Part Number | Description |
|---|---|
| 10 | excavator |
| 11 | undercarriage |
| 12 | endless track |
| 13 | enclosure |
| 14 | upper |
| 15 | cab |
| 16 | boom |
| 17 | boom section |
| 18 | boom section |
| 19 | distal end |
| 20 | extensible ram |
| 21 | opening |
| 22 | boom section end |
| 23 | boom opening |
| 24 | bucket |
| 25 | scraper |
| 26 | proximal end |
| 27 | distal end |
| 28 | connector |
| 29 | fixture |
| 30 | fixture |
| 31 | tooth/teeth/blade |
| 32 | upper surface |
| 33 | lower surface |
| 34 | scraper frame |
| 35 | longitudinal beam |
| 36 | transverse beam |
| 37 | lower plate |
| 38 | upper plate |
| 39 | tooth receptive socket |
| 40 | side plate |
| 41 | side plate |
| 42 | transverse beam |
| 43 | side plate |
| 44 | side plate |
| 45 | beam |
| 46 | gusset plate |
| 47 | padeye |
| 48 | padeye |
| 49 | opening |
| 50 | padeye |
| 51 | opening |
| 52 | rod |
| 53 | scraper |
| 54 | central frame section |
| 55 | proximal frame section |
| 56 | central frame section |
| 57 | implement |
| 58 | tooth/blade |
| 59 | projection |
| 60 | socket |
| 61 | fixture |

-continued

PARTS LIST

| Part Number | Description |
|---|---|
| 62 | bridge |
| 63 | debris/sediment |
| 64 | water line |
| 65 | arrow |
| 66 | arrow |
| 67 | implement/plow |
| 68 | deck |
| 69 | blade |
| 70 | upper beam |
| 71 | blade |
| 72 | perimeter |
| 73 | upper beam |
| 74 | mesh/screen |
| 75 | implement |
| 76 | drum |
| 77 | projection |
| 78 | frame |
| 79 | hydraulic motor |
| 80 | hydraulic line |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. An excavator, comprising:

a) a frame;

b) an undercarriage having a ground engaging propeller that enables the undercarriage to move the frame;

c) the frame including an upper working portion that supports an elongated articulating boom having at least two boom sections that are pivotally connected;

d) the frame including a cab having a motor drive and a hydraulic system that powers the boom, the cab rotatable upon the undercarriage about a generally vertical axis;

e) the boom having a distal end portion with a bucket that has one or more bucket teeth;

f) a scraper having one end connected to the boom distal end portion and another end that is extendable to a position generally below the cab and to the vertical axis;

g) a connection that joins the boom distal end to the scraper; and h) the connection including a connection of the bucket to a proximal end of the scraper and to an upper surface of the scraper, wherein the bucket tooth connects to the scraper at a position that is in between the scraper ends.

2. The excavator of claim 1 wherein the scraper has a proximal end with a vertically extending bucket mount that extends around opposing sides of the bucket.

3. The excavator of claim 1 wherein the scraper has an upper surface and a lower surface, the bucket connecting to the scraper above the upper surface.

4. The excavator of claim 1 wherein the scraper has a distal end portion with one or more teeth.

5. The excavator of claim 1 wherein the scraper has a distal end portion with a plurality of teeth.

6. The excavator of claim 4 wherein the one or more teeth extend downwardly.

7. The excavator of claim 5 wherein the plurality of teeth extend downwardly.

8. The excavator of claim 1 wherein the connection enables quick disconnect of the bucket and scraper, without a need to disconnect any fasteners that extend through the bucket and scraper.

9. The excavator of claim 1 wherein the bucket is not bolted to the scraper.

10. The excavator of claim 8 wherein the bucket is not bolted to the scraper.

11. The excavator of claim 1 wherein the connection can be perfected by rotating the bucket relative to the scraper.

12. The excavator of claim 8 wherein the disconnect can be perfected by rotating the bucket relative to the scraper.

13. The excavator of claim 11 wherein the connection is perfected by rotating the bucket toward the middle of the scraper.

14. The excavator of claim 12 wherein the disconnect is perfected by rotating the bucket away from the middle of the scraper.

15. An excavator, comprising:

a) a frame;

b) an undercarriage having a ground engaging propeller that enables the undercarriage to move the frame;

c) the frame including an upper working portion that supports an elongated articulating boom having at least two boom sections that are pivotally connected;

d) the frame including a cab having a motor drive and a hydraulic system that powers the boom, the cab rotatable upon the undercarriage about a generally vertical axis;

e) the boom having a distal end portion fitted with a bucket having a bucket tooth;

f) a scraper having one end connected to the bucket and another end that is extendable to a position generally below the cab;

g) a connection that joins the bucket to the scraper; and h) the connection including a connection of the bucket to the proximal end of the scraper and to the upper surface of the scraper, wherein the bucket tooth connects to the scraper at a position that is in between the scraper ends.

16. The excavator of claim 15 wherein the boom is pinned to the scraper at two spaced apart positions.

17. The excavator of claim 16 wherein the boom has a distal end that includes an extensible ram, the ram being connected to the scraper at one of the two spaced apart positions and another part of the boom that is not the ram being connected to the other of the two spaced apart positions.

18. The excavator of claim 15 wherein the scraper has a distal end portion with one or more teeth.

19. The excavator of claim 15 wherein the scraper has a distal end portion with a plurality of teeth.

20. The excavator of claim 18 wherein the one or more teeth extend downwardly.

* * * * *